United States Patent [19]

LaForce, Jr.

[11] Patent Number: 4,964,183

[45] Date of Patent: Oct. 23, 1990

[54] TANNING TUB

[76] Inventor: James W. LaForce, Jr., c/o TAN-N-TUB, P.O. Box 6100, Chico, Calif. 95927

[21] Appl. No.: 262,167

[22] Filed: Oct. 18, 1988

Related U.S. Application Data

[63] Continuation of Ser. No. 107,542, Oct. 13, 1987, abandoned.

[51] Int. Cl.[5] ..... A47C 27/10

[52] U.S. Cl. ..... 5/421; 5/420; 5/449; 5/457; 5/441

[58] Field of Search ..... 5/417–421, 5/441, 449, 455, 457; 128/372, 376; 4/585, 588, 589; 441/129–132; 297/DIG. 3

[56] References Cited

U.S. PATENT DOCUMENTS

| | | | |
|---|---|---|---|
| 585,834 | 7/1897 | Ruth | 5/455 X |
| 2,672,628 | 3/1954 | Spanel | 4/588 X |
| 2,842,738 | 7/1958 | Druck | 5/457 |
| 3,058,122 | 10/1962 | McDaniel et al. | 5/449 X |
| 3,363,272 | 1/1968 | Channon | 5/431 |
| 3,503,084 | 3/1970 | Meinwieser | 5/457 |
| 3,680,917 | 8/1972 | Harris | 5/441 X |
| 3,688,775 | 9/1972 | Raymann | 128/372 X |
| 3,740,095 | 6/1973 | Nail | 5/455 X |
| 4,136,412 | 1/1979 | Wilhelm | 128/376 X |
| 4,744,112 | 5/1988 | Keesling, Jr. | 5/449 X |

*Primary Examiner*—Michael F. Trettel

[57] ABSTRACT

The invention provides a tanning tub which can be inflated for use and deflated for transporting and for storage. Two tubular walls vertically stacked support a tubular air mattress attached suspended centrally between the walls. The tubes in the tubular mattress have clear plastic upper surfaces and the opposite tube sides are fabricated of silvery colored material. The tubular walls and the tubular mattress when inflated form into a water proof container which can be used by a sunbather to relax in a cool pool of water. The clear top and silvery bottom arrangement of the mattress tubes allows a sunbather to tan on both sides at the same time, one side by direct exposure and the other side by reflection. The inflated tanning tub can be used as a float in a pool, for tanning dry on land, and as a bed for camping or a spare bed at home.

2 Claims, 11 Drawing Sheets

TANNING TUB

This is a continuation of application Ser. Nr. 107,542 filed Oct. 13, 1987 now abandoned.

BACKGROUND OF THE INVENTION

1. Field of the Invention

This invention relates to light weight, soft-bodied receptacles useful for sunbathing. The present invention is particularly directed towards an inflatable tub-like structure waterproofed and having reflective qualities so the user can recline partly submerged in water while sunbathing.

2. Description of the Prior Art

A few lounges and tub-like devices for sunbathing are shown in early issued patents. Most seem complicated and not necessarily designed for the comfort of the user. Others appear somewhat like torture devices useful only by the most Spartan sunbather. Some air mattresses for bed and in-pool use are seen.

The patents considered most pertinent to the present invention included the following:

A patent issued to L. P. Kessman, number 3,170,172, on Feb. 23, 1965, seems to offer a little too much cooking for the unwary sunbather.

Patent number 3,363,272, issued to R. M. Channon on Jan. 16, 1968, encases the bather in a rather uncomfortable looking mold form.

The lounge means of patent number 3,688,775, Sept. 5, 1972, granted to E. F. Raymann, looks comfortable and convenient until a closer examination of the slanted walls reveals a narrow and restricted resting area.

A shallow tub-like receptacle patented by J. R. Tersch, patent number 3,835,482, Sept. 17, 1974, is a light weight tanning device in a one-piece molded designs. Transporting this full size tub in a compact car seems the principal objection.

The device of McDaniel et al, patent number 3,058,122, dated Oct. 16, 1962, illustrates an inflatable tubular walled, flat bed tub-like structure "to bed and wash a human body." McDaniel shows equally sized stacked inflatable tube side walls having a double lined bottom attached under the lower tube.

To the best of my knowledge, primarily for sunbathing purposes, the foregoing patents were most pertinent to the present invention. These past-art patents do not appear to disclose a sunbathing tub offering the convenience and flexibility of my invention.

SUMMARY OF THE INVENTION

In practicing my invention, I have provided a tanning tub which can be inflated and used on land for lounging in the sun in a cool pool of water during sunbathing. Also, inflated, my tanning tub can be used dry as a bed or for supporting a reclining sunbather floating in a swimming pool. Deflated, the tub structure folds into a small package easily transported. The tanning tub assemblage includes two vertically stacked inflatable tubular wall members circuitously supporting an inflatable tubular air mattress attached suspended centrally between the walls The entire tanning tub is fabricated of a soft pliable but heavy vinyl. A single welding attaches the air mattress to a singular tubular side wall and when the attachment is made, the single welding produces the upper wall member and the lower wall member of the stacked side walls. A water proof container is formed when the stacked tube members and the air mattress are inflated. Each tubular wall member and the air mattress, although permanently attached, can be inflated and deflated independently. The top half of the vinyl air-inflated tubing comprising the air mattress is structured of clear plastic material and the walls on the bottom half of the same air-inflated mattress tubing is structured of materials having a reflective silvery finish. This clear top and silvery bottom arrangement allows a sunbather to tan on both sides at the same time, one side by direct exposure and the other side by reflection. The tanning tub structure is water tight, as previously stated, and when inflated can be used floating in a pool or on a patio with water inside the tanning tub for sunbathing in a cool pool of water. The entire tanning tub except the clear plastic top of the air mattress is fabricated of the same silvery vinyl material. An optional plastic pillow having similar reflective tanning qualities is provided.

Therefore, it is a principal object of this invention to provide a comfortable, inflatable tub-like structure for sunbathers with a tub body finished in high-tech styling.

A second principal object is to provide a tanning tub with an inflatable air mattress structured with a clear plastic top and a reflective silvery colored interior bottom designed for full body sun tanning by direct exposure on the sunbather's upper side and by reflected sunlight on the sunbather's under side.

Another object of my invention is to provide a waterproofed tanning tub sized so the user can rest full length partially submerged in cool water.

A further object of the invention is to provide an inflatable tanning tub which can be deflated and packaged easily for transporting purposes.

A still further object of my invention is to provide a comfortable air mattress encompassed by tubular walls with the mattress and the two walls arranged with individual air valves allowing each to be inflated to a desired firmness.

Other objects and the many advantages of this invention will become obvious with a reading of the specification in relationship to the numerical parts shown in the included drawings.

A BRIEF DESCRIPTION OF THE DRAWINGS

The nature of this invention may be better understood by reference to the structural form of the tanning tub in the drawings. Although the tub structure of the invention is deflateable and would be assembled and attached in this condition, for easer understanding, the tanning tub and tub members are shown principally in inflated form as illustrated by the accompanying drawings in which.

Figure 11:
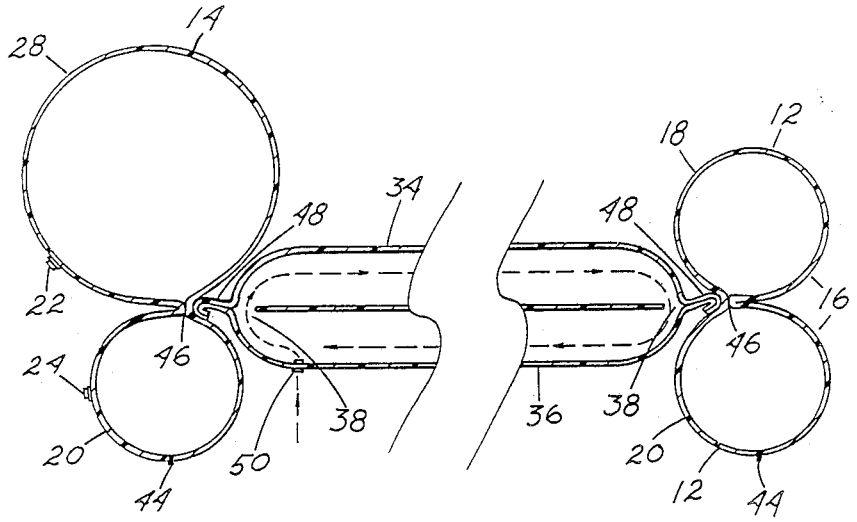

FIG. 11 is a side sectional shortened view of the assembled tanning tub inflated showing the end wall attachments with the air mattress suspended between the two stacked wall tubes and illustrating the air entering the air mattress controllable air valve and passing along communicating openings at the foot and head ends of the air mattress tubing. Individual controllable air valves are illustrated at the head end for upper and lower wall tube inflation and deflation.

Figure 12:
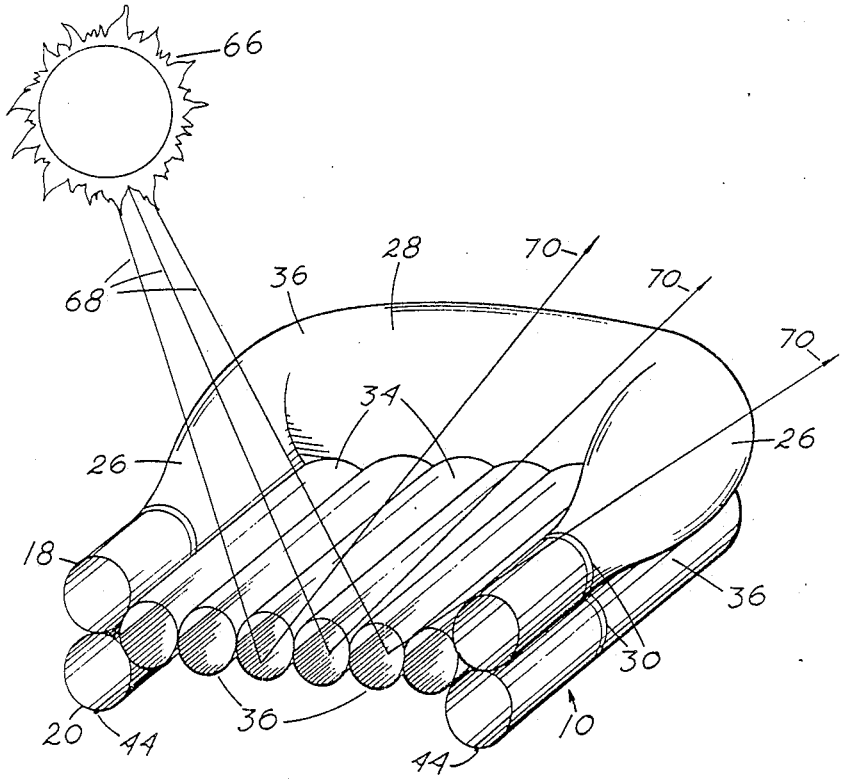

FIG. 12 illustrates the functional structure of the tanning tub in a half cut perspective view towards the tub head showing how the sun rays pass through the clear plastic top and are reflected upwards by the silvery colored interior bottom material of the plastic air mattress.

Figure 13:
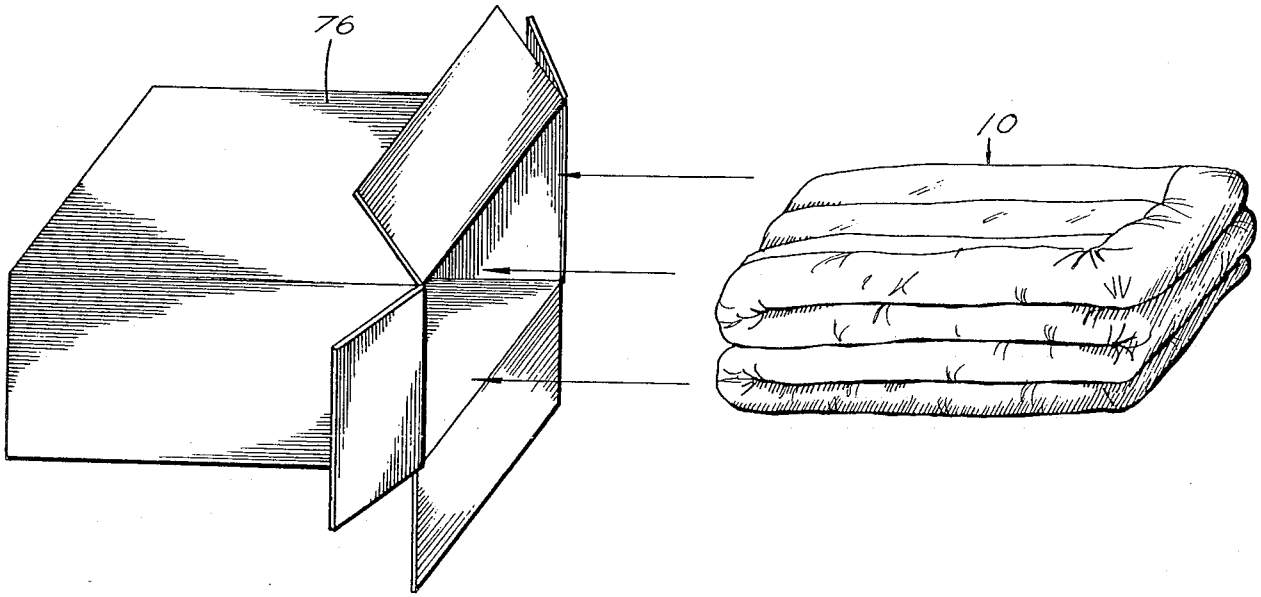

FIG. 13 shows the tanning tub deflated, folded, and ready for packaging.

Figure 14:
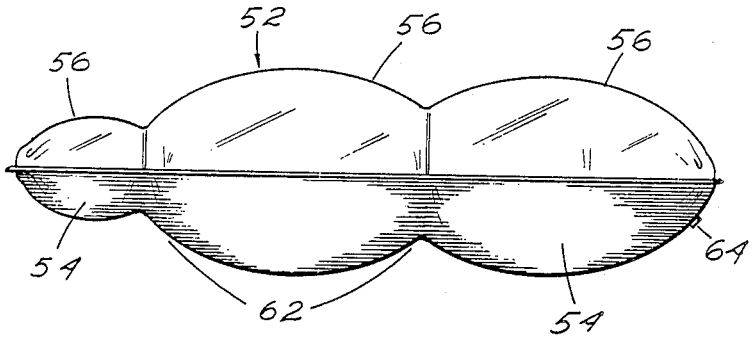

FIG. 14 shows the profile of an inflatable plastic pillow sectioned by partitions to produce opposing convexed sections particularly shaped for pillow retention against short back rests and the pillow structured with clear plastic top material, silvery bottom material, and silvery partition material.

Figure 15:
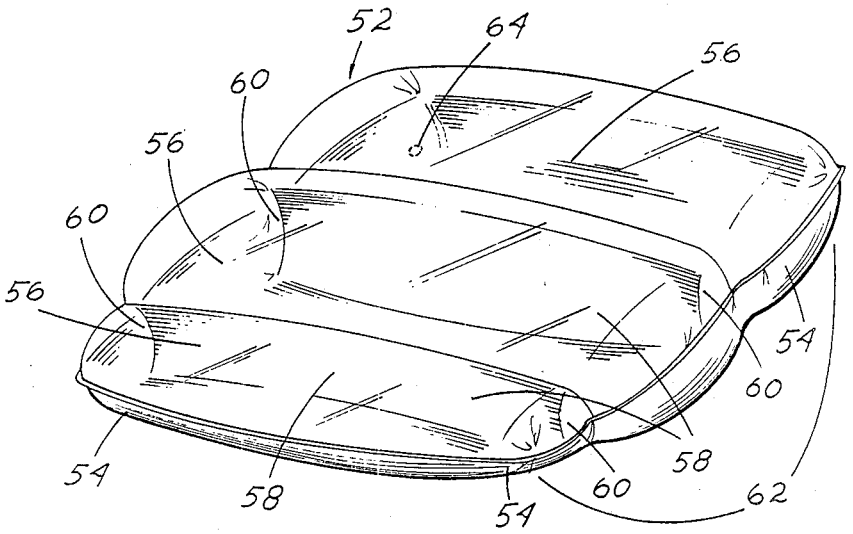

FIG. 15 shows the inflatable plastic pillow of FIG. 14 in a perspective view illustrating air passage openings at the ends of the sectioning partitions allowing the inflated pillow to round out along the edges.

Figure 16:
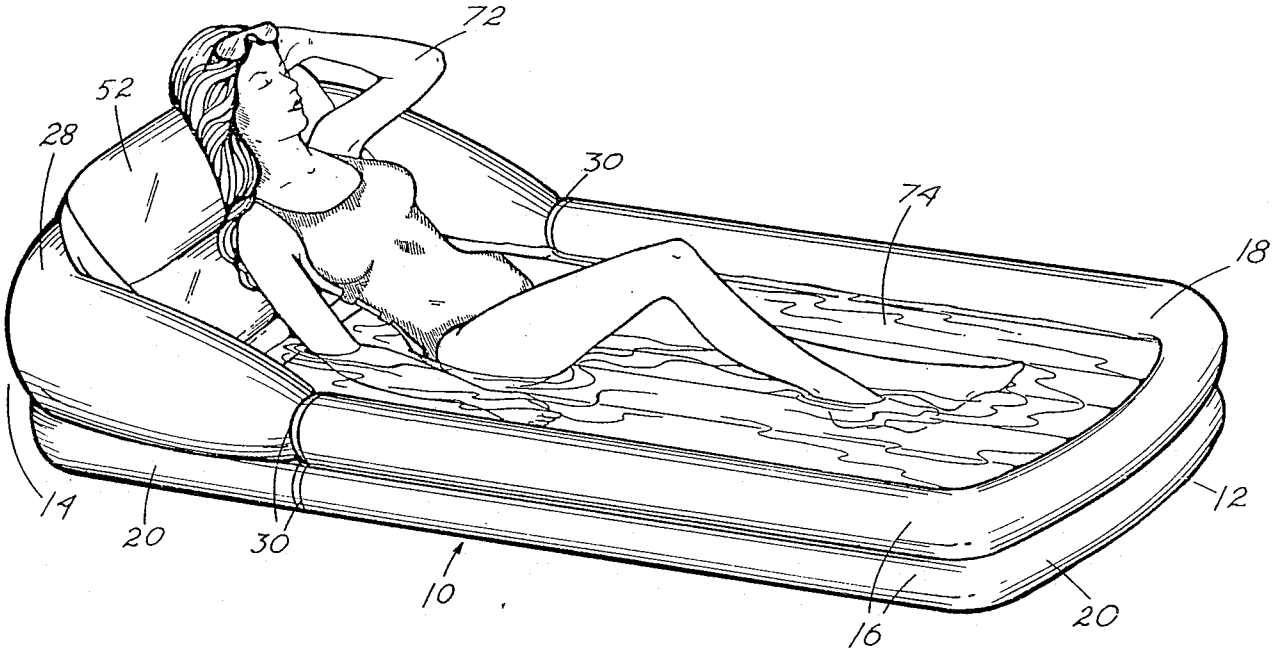

FIG. 16 shows the tanning tub of this invention with the pillow in place being used by a sunbather who is reclining in a cool pool of water.

DRAWING REFERENCE NUMERALS

10: tanning tub
12: foot
14: head
16: inflatable stacked tubular walls
18: upper wall tube member
20: lower wall tube member
22: upper wall tube air valve
24: lower wall tube air valve
26: raised arm rests
28: enlarged head rest
30: wall tubes divisional double seam
32: inflatable tubular mattress
34: clear plastic material
36: silvery plastic material
38: air passage openings
40: strip heat sealing welds
42: reinforcing loop sealed ends
44: base seam
46: tube forming attachment seam
48: tubular mattress attachment extension
50: mattress air valve
52: plastic pillow
54: pillow base silvery plastic material
56: pillow top clear plastic material
58: silvery plastic pillow partitions
60: air passage unattached pillow partition ends
62: pillow position retention shape
64: pillow air valve
66: illustrative sun
68: sun ray path
70: reflected sun rays
72: sunbather
74: water
76: box.

DESCRIPTION OF THE PREFERRED EMBODIMENT

Figure 1:
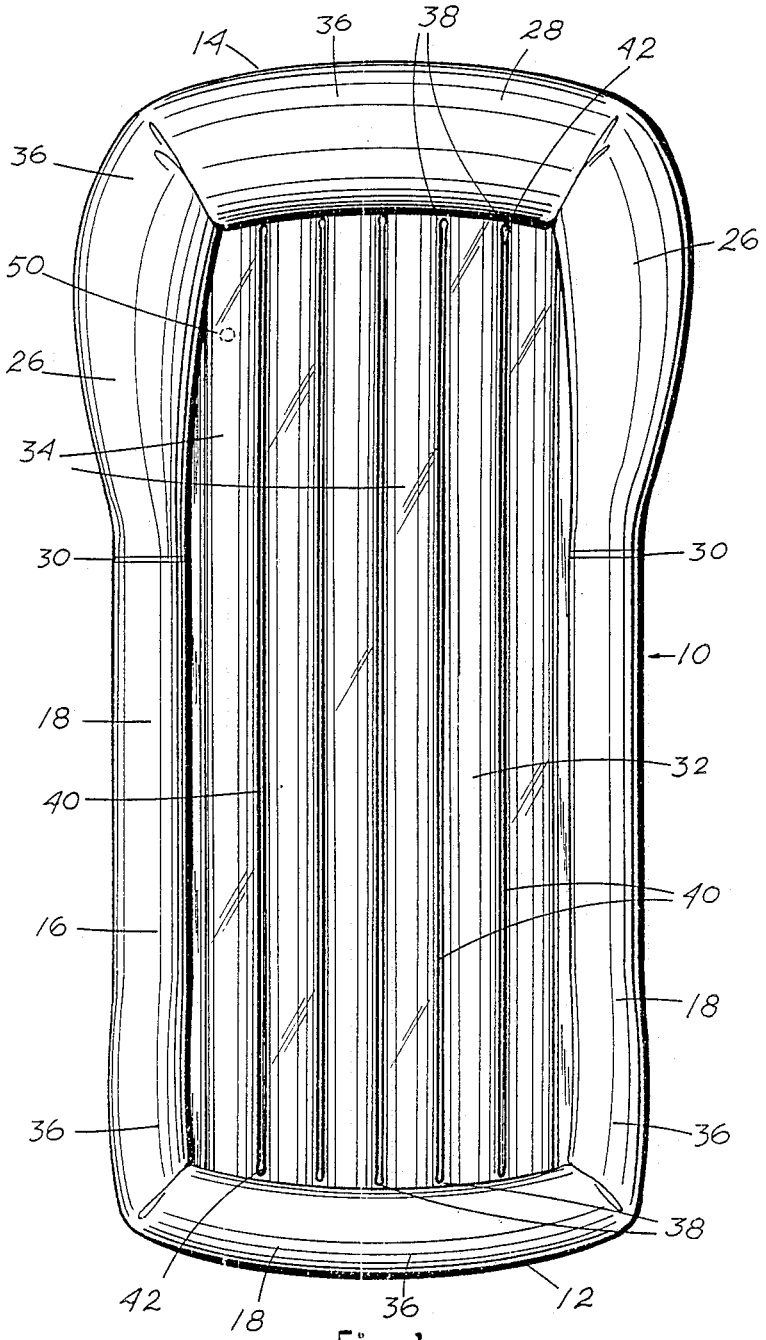
FIG. 1 shows the preferred embodiment of the tanning tub inflated in a top plan view.
Figure 5:
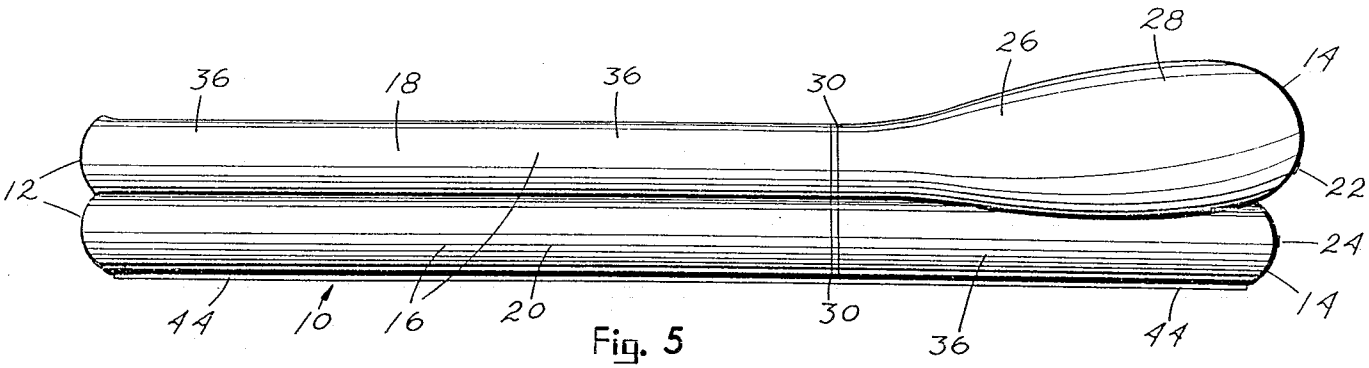
FIG. 5 shows the tanning tub inflated in a side view with the foot end left in the drawings illustrating stacked tubular side wall members.
Figure 7:
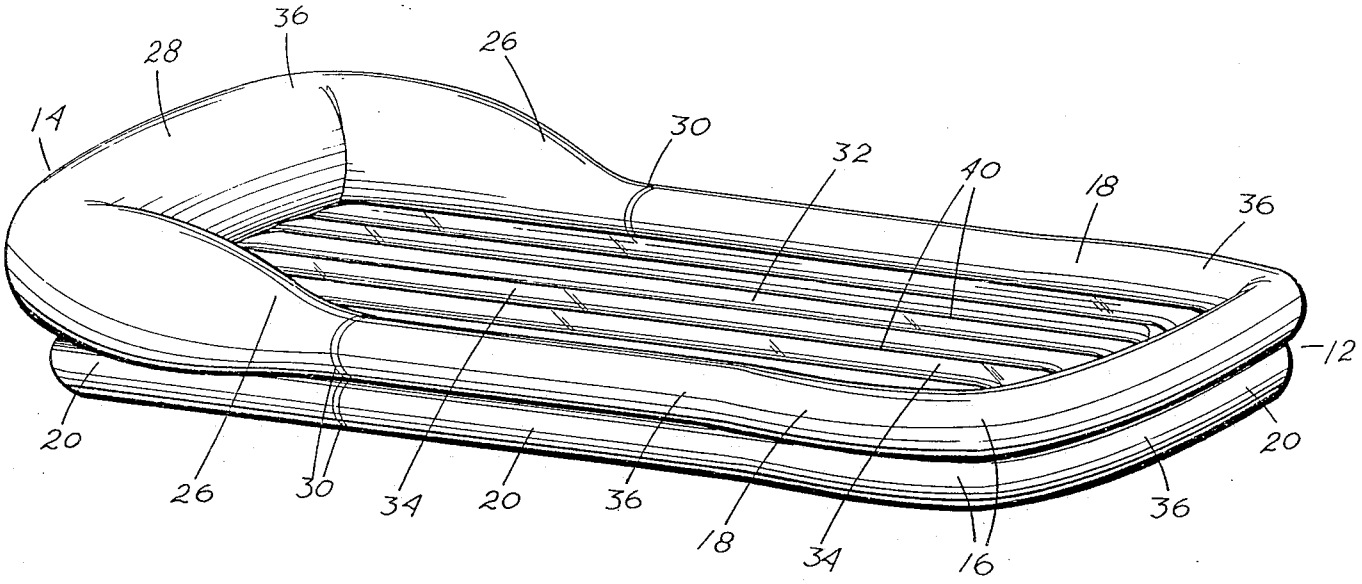
FIG. 7 is a perspective view showing the tanning tub inflated with the head end positioned left in the drawing and illustrating the tanning tub in an angular position with the top side upwardly.

Referring now to the drawings at FIG. 1 where my tanning tub is shown in the preferred embodiment inflated and designated tanning tub 10. In FIG. 1, tanning tub 10 is illustrated in a top plan view with foot 12 downwardly and head 14 upwardly. Inflatable tubular mattress 32, having functional characteristics described further on in the specification, is shown framed by inflatable stacked tubular walls 16 of which upper wall tube member 18 is the section which can be seen. Along both upper sides of tanning tub 10 as shown in FIG. 1, upper wall tube member 18 forms into raised arm rests 26 which are inclined upwardly and outwardly from a uniform sized upper wall tube member 18 at wall tubes divisional double seam 30 to an enlarged head rest 28 at head 14. Raised arm rests 26 and enlarged head rest 28 are an enlarging continuation of upper wall tube member 18. As best seen in FIG. 7, upper wall tube member 18 is the uppermost tube of two stacked tubes 18 and 20 which are formed from a single large tube to which inflatable tubular mattress 32 is welded to produce inflatable stacked tubular walls 16. Inflatable stacked tubular walls 16 form attached circuitous walls for inflatable tubular mattress 32 and when the attached members are inflated, a bedded water proof container, tanning tub 10, is produced. See FIG. 5 to view inflatable stacked tubular walls 16 in a side view.

Figure 2:
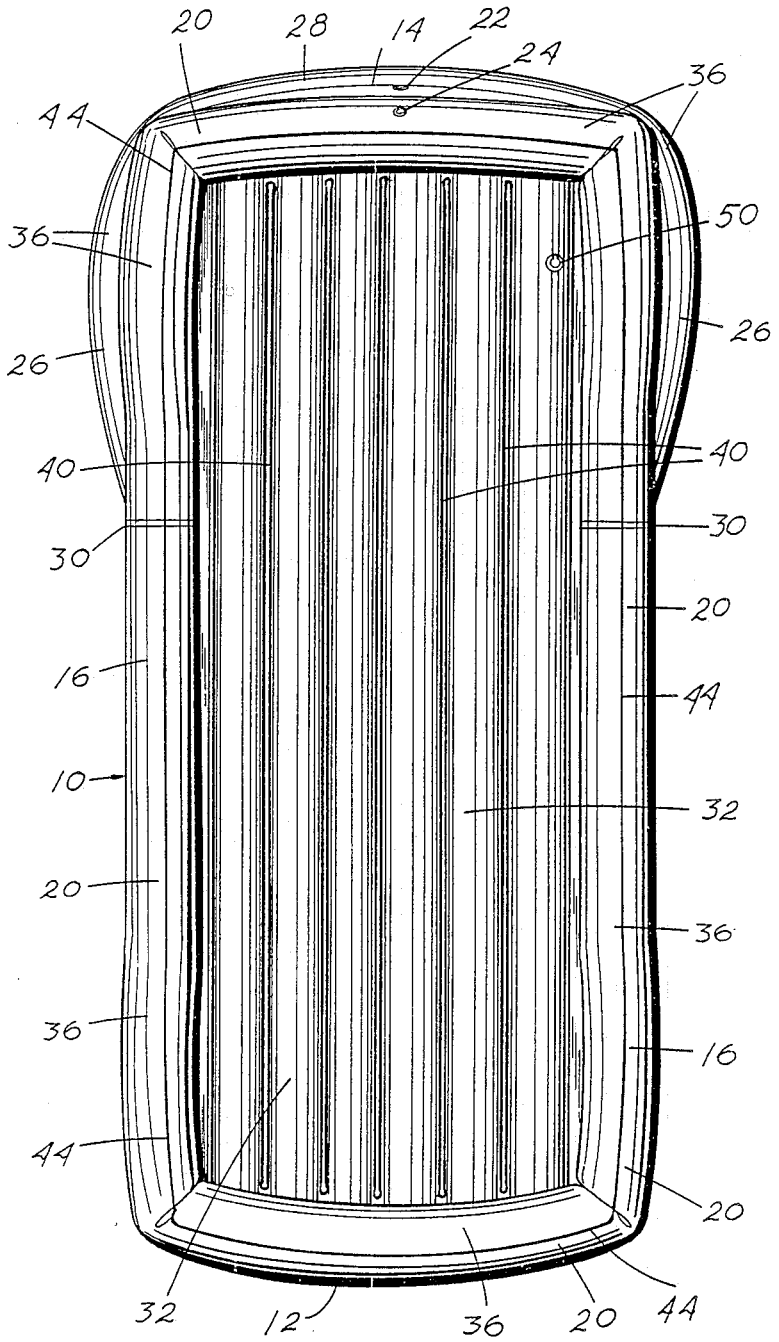
FIG. 2 shows FIG. 1 in a bottom plan view.

FIG. 2 shows the underside of tanning tub 10. In this view, lower wall tube member 20 of inflatable stacked tubular walls 16 is prominently displayed under suspended inflatable tubular mattress 32. The outer edges of raised arm rests 26 and enlarged head rest 28 can be seen extending outwardly somewhat past the outer edge of lower wall tube member 20 on both sides and across head 14 upwardly in the drawing. The uniform size and continuousness of lower wall tube member 20 along both sides of tanning tub 10 and transversely at head 14 and foot 12 is shown in FIG. 2. The arrangement for various tubular sections of tanning tub 10 to be individually inflated by air through controllable air valves 22, 24, and 50 also can be seen in FIG. 2. The sections are deflateable by releasing air through the same valves. Enlarged head rest 28 has upper wall tube air valve 22 in the curved head end illustrated at the top of tanning tub 10 in the drawing at FIG. 2. Lower wall tube member 20 has lower wall tube air valve 24 at the head end also illustrated in FIG. 2 upwardly at the top of tanning tub 10 in head 14. Inflatable tubular mattress 32 is inflated and deflated through mattress air valve 50 shown upwardly adjacent the right hand corner in the bottom of a longitudinal tube of inflatable tubular mattress 32.

Figure 3:
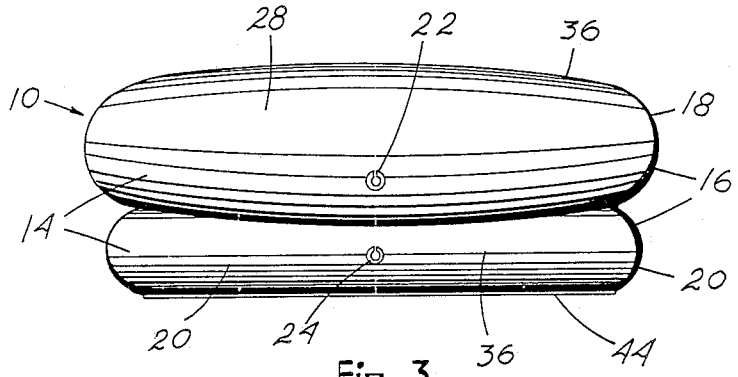
FIG. 3 shows the tanning tub inflated in an end view from the head end.
Figure 4:
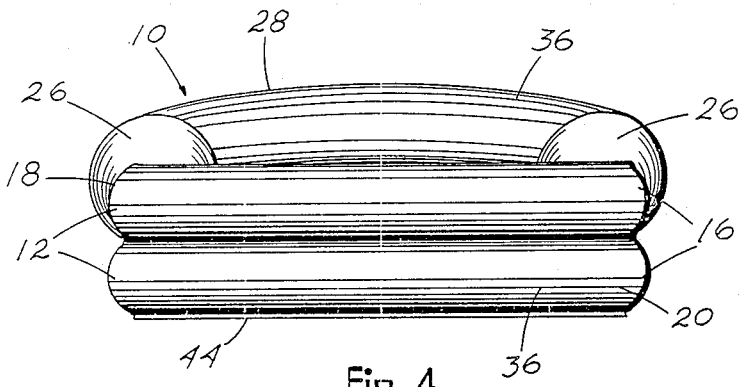
FIG. 4 shows the tanning tub inflated in an end view from the foot end.
Figure 6:
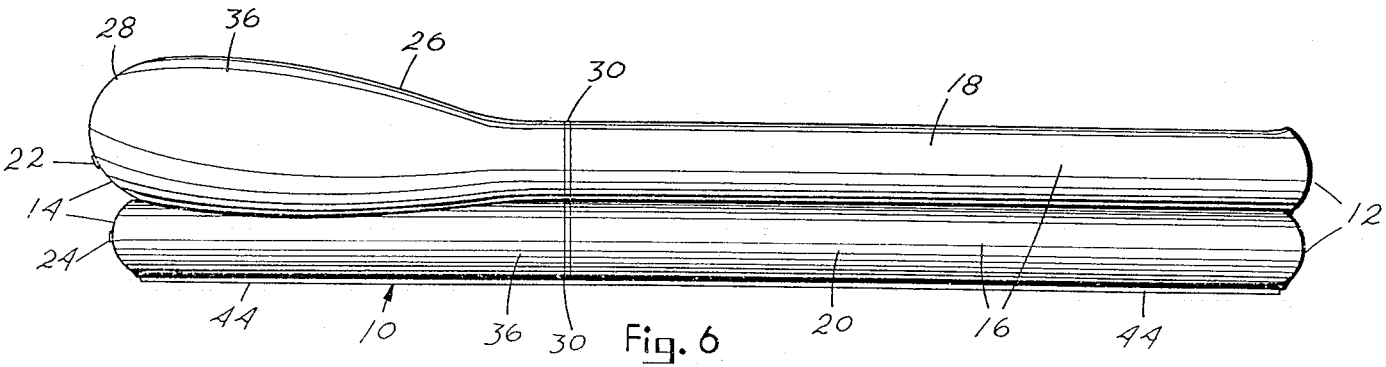
FIG. 6 shows the tanning tub in an opposite side view from FIG. 5 with the head to the left in the drawing.

Referring back to FIG. 1, upper wall tube member 18 extends uniformly downwardly from the divisional position at wall tubes divisional double seam 30 on one side of tanning tub 10 transversing foot 12 and coursing upwardly encompassing the lower half of tanning tub 10 and ending at a second divisional position wall tubs divisional double seam 30 on the opposite side of tanning tub 10. FIG. 2 illustrates how lower wall tubular member 20 supports and in a uniform size completely frames inflatable tubular mattress 32. FIG. 3 shows tanning tub 10 from head 14 in an end view. Enlarged head rest 28 is shown positioned above lower wall tube member 20 as a part of inflatable stacked tubular walls 16. Upper wall tube air valve 22 and lower wall tube air valve 24 are illustrated. FIG. 4 shows tanning tub 10 from the foot end illustrating the uniform size of both upper wall tube member 18 and lower wall tube member 20 where they transverse foot 12 of tanning tub 10. Further illustrations of inflatable tubular stacked walls 16 and the enlargement of raised arm rests 26 from wall tubes double seams 30 to enlarged head rest 28 at head 12 can be seen in alternate side views at FIG. 5 and FIG. 6. The illustrations show the uniform size of inflatable stacked tubular walls 16 from wall tubes double seams 30 to foot 12.

Figure 8:
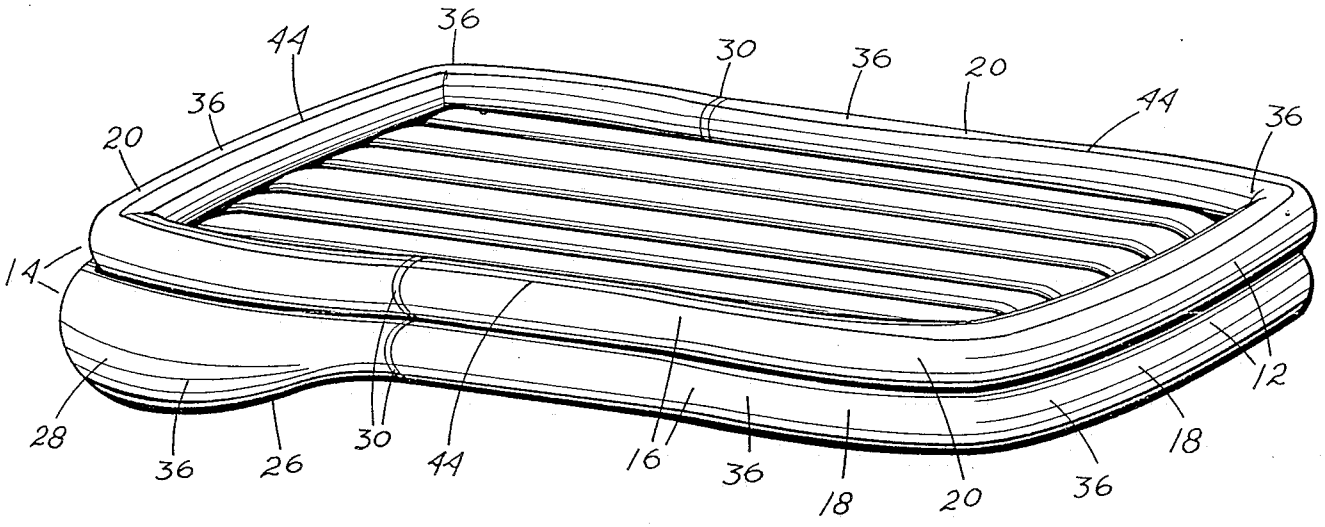
FIG. 8 is a perspective view of the tanning tub inflated from the bottom side illustrating the suspension of the air mattress section centrally between the stacked tubular tub walls.
Figure 9:
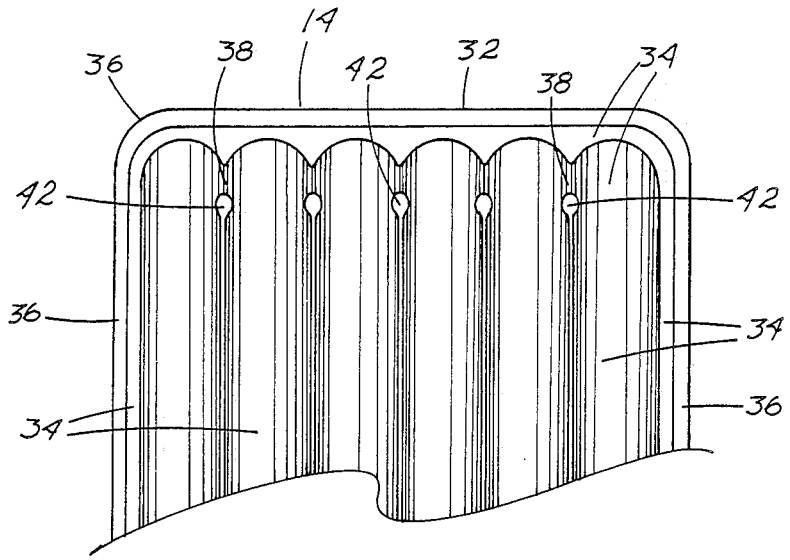
FIG. 9 is a cut off top plan view of one end of the inflatable tubular air mattress illustrating looped reinforcing welds adjacent air passageways at the ends of the tubes and showing the extended peripheral attachment silvery bottom material.
Figure 10:
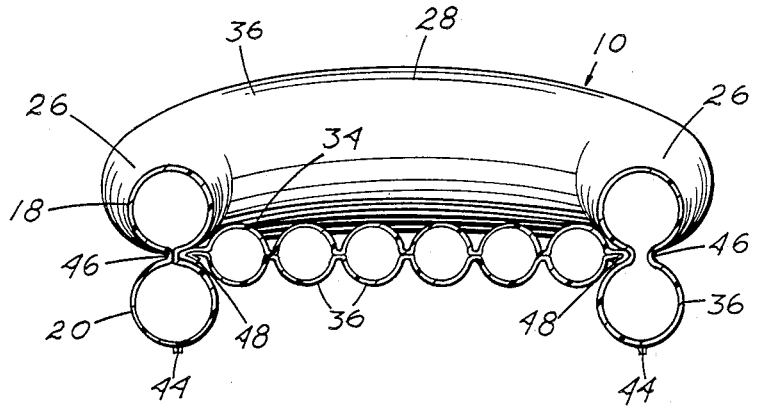
FIG. 10 is a foot end view of the tanning tub members inflated and sectioned to illustrate positioning of the air mattress side peripheral attachment extensions producing two stacked wall members from a single tube through longitudinal attachment centrally by a single weld.

The suspension of inflatable tubular mattress 32 in tanning tub 10 between upper wall tube member 18 and lower wall tube member 20 can be seen in FIGS. 7–12. The manner of attaching inflatable tubular mattress 32 between upper wall tube member 18 and lower wall tube member 20 of inflatable stacked tubular walls 16 is illustrated in FIGS. 9 and 10. Inflatable tubular mattress 32, affixed as the suspended bed of tanning tub 10, extends full length and full width centrally in tanning tub 10 providing internal air mattressing for the tanning tub. The components comprising tanning tub 10 are fabricated of pliable heavy vinyl materials. Inflatable tubular mattress 32 is designed to be inflated and deflated to a desired hardness through mattress air valve 50.

FIG. 7 is a perspective drawing of tanning tub 10 in use position with upper wall tube member 18 shown upwardly and lower wall tube member 20 shown downwardly. Enlarged head rest 28 is left in the drawing and raised arm rests 26 slope upwardly and enlarge outwardly on both sides of tanning tub 10 from a smaller size at the division position, wall tubes divisional double seam 30, to a larger size where they form into enlarged head rest 28 at head 14 position. Lower wall tube member 20 affixed circuitously under suspended inflatable tubular mattress 32 is a base support for tanning tub 10. The clear plastic material 34 used as the upper half of the mattress tube material of inflatable tubular mattress 32 is visible between the sides and end formings of upper wall tube member 18.

FIG. 8 shows tanning tub 10 bottom side up. Lower wall tube member 20 completely frames inflatable tubular mattress 32 which is suspended between the walls of inflatable tubular walls 16. Silvery plastic material 36, the material of which the lower half of the tubes in inflatable tubular mattress 32 is fabricated, can be seen in FIG. 8 facing upwardly. All of tanning tub 10 is manufactured of silvery plastic material 36 except the top side of inflatable tubular mattress 32 which as previously described has the upper halves of the tubes manufactured of clear plastic material 34. In FIG. 8, mattress air valve 50 can be seen adjacent the upper left hand corner of tanning tub 10 through the bottom at the end of an edgewise tube in inflatable tubular mattress 32.

FIG. 9 shows one end of inflatable tubular mattress 32 in a partial top plan view of which the opposite end is the same. The illustration shows air passage openings 38 in the ends of the mattress tubes. The mattress tubes have been formed by strip heat sealing welds 40 attaching clear plastic material 34 over the top of silvery plastic material 36. The attachments are longitudinal and spaced to form tubes of predetermined size when inflatable tubular mattress 32 is blown up by air through mattress air valve 50. A single run of strip heat sealing welds 40 also attaches clear plastic material 34 over the top of silvery plastic material 36 circuitously along all edges. For additional strength, the ends of the attachments formed by strip heat sealing welds 40 in the tube area are tear dropped into reinforcing loop sealed ends 42 adjacent air passage openings 38. Tubular mattress attachment extension 48, an edge extension of the silvery plastic material 36 used in the bottom of the tubes, is seen framing the mattress structure. Tubular mattress attachment extension 48 is the edging by which inflatable tubular mattress 32 is attached to tube forming attachment seam 46 and suspended between the tubes of inflatable stacked tubular walls 16.

FIG. 10 shows a sectional view of tanning tub 10 in inflated form from foot 12 towards head 14. The drawing illustrates a single seam weld attachment between the tubular mattress attachment extension 48 and the wall tube forming attachment seam 46. Although tanning tub 10 is shown inflated in most of the drawings to better detail the tube relationship, tanning tub 10 is illustrated deflated in FIG. 13 as it would be for packaging in box 76. Tanning tub 10 would also be deflated for transporting, for storage, and during the manufacturing and sealing process. During manufacturing and seam welding, after pattern cutting, single sheets of the plastic material are doubled over and heat sealed along base seam 44 to produce a single wide tubular form of inflatable stacked tubular walls 16. The head section is separate from the foot section and the two sections are double heat seamed end to end at a divisional point, wall tubes divisional double seam 30. This produces a large single tube similar to an enlarged deflated vehicular tire inner tube. When tubular mattress attachment extension 48 is welded by heat sealing longitudinally centrally along the inside of the wall tube, tube forming attachment seam 46 is the end result producing upper wall tube member 18 and lower wall tube member 20 combined in inflatable stacked tubular walls 16 with inflatable tubular mattress 32 attached longitudinally between the two formed walls. Using this method, by a single central sealing, inflatable tubular mattress 32 is attached suspended between tubes 18 and 20 and tanning tub 10 is formed. For individual tube inflation, upper wall tube air valve 22 is installed in the head end of upper wall tube member 18 through enlarged headrest 28 and lower wall tube air valve 24 is installed in the head end of lower wall tube member 20.

The method I have described of attaching an inflatable air mattress centrally to a single tube wall to form double tubular walls with the mattress suspended between the walls accomplished by a single heat sealing is newly developed by myself and is not a common procedure used by plastic fabricators.

FIG. 11 is a side sectional view of tanning tub 10. Inflatable tublar mattress 32 is shortened illustrating the head 14 and foot 12 connecton of wall tube forming attachment seam 46 to tubular mattress attachment extension 48. Air passage openings 38 allowing air to pass from tube to tube at the ends of the tubes in inflatable tubular mattress 32 at reinforced loop sealed ends 42 is illustrated. Upper wall tube air valve 22 and lower wall tube air valve 24 are shown left in the illustration at head 14. Mattress air valve 50 is shown downwardly towards head 14 through the bottom of the silvery plastic material 36 being lower halves of the tube material used in inflatable tubular mattress 32.

FIG. 14 and FIG. 15 illustrate a pillow, plastic pillow 52, having similar characteristics to tanning tub 10. Plastic pillow 52 is uniquely shaped, pillow position retention shape 62, to remain in a fixed angled position when placed inside tanning tub 10 against enlarged head rest 28. Pillow position retention shape 62 also allows plastic pillow 52 to bend and maintain a fixed position when used against a variety of low back rests. Pliability in the material, the shape of the pillow structure, and the user's weight holds the pillow positioned when the pillow is used inflated as illustrated in FIG. 16. Plastic pillow 52 is shaped substantially rectangularly with rounded corners and sides. Plastic pillow 52 is fabricated with the upper half of clear plastic pillow top material 56 and the lower half of silvery plastic pillow base material 54. Two substantially rectangular partitions, silvery plastic pillow partitions 58, are fastened along one longitudinal side to clear plastic pillow top material 56 and along a second longitudinal side to silvery plastic pillow base material 54. Silvery plastic pillow partitions 58 contribute to the maintenance of pillow position retaining shape 62. At the shorter ends, silvery plastic pillow partitions 58 are unfastened which allows plastic pillow 52 to round out along the sides into soft curves when inflated and provides air openings between the partitioned sections designated air passage unattached pillow partition ends 60 so plastic pillow 52 can be inflated and deflated from a single pillow air valve 64. Plastic pillow 52 provides the same two-sided tanning features as does tanning tub 10.

FIG. 13 shows tanning tub 10 sectioned upwardly towards head illustrating the basic principle and the structural design used to accomplish reflective body tanning for which this invention is designed. The positional relationship of inflatable stacked tubular walls 16, raised arm rests 26, enlarged headrest 28, and suspended inflatable tubular mattress 32 are shown. Illustrative sun 66 is shown sending sun rays down sun ray path 68 which pass through clear plastic material 34, the upper half of the material used in the tubes of inflatable tubular mattress 32, to strike silvery plastic material 36, the silvery reflective material of which the lower half of the mattress tubes of inflatable tubular mattress 32 are structured. Sun ray path 68 is then reflected upwards and would be beneficial for tanning the downwardly positioned side of a sunbather reclining on the inflated surface of inflatable tubular mattress 32.

FIG. 16 shows tanning tub 10 with plastic pillow 52 in place being used by sunbather 72. In the drawing, sunbather 72 is using tanning tub 10 with a coolant, water 74, in the tub structure. FIG. 16 illustrates the primary object of the invention, to sunbathe while reclining in a cool pool of water. The invention, however, has many other uses which include sunbathing in tanning tub 10 dry on land with and without plastic pillow 52 and using tanning tub 10 as a float in a pool. The side wall tubes projecting below the inflated mattress provide excellent buoyancy for pool use. Deflated, tanning tub 10 can be folded into a very small package, see FIG. 13, making the invention easily portable with or without box 76 and ideal as an inflatable bed for both indoor and outdoor use.

Although I have described my invention with considerable details in the foregoing specification, it is to be understood that variations in the structure and design may be practiced so long as these variations do not exceed the intended scope of the appended claims.

What is claimed is:

1. An inflatable portable tub-like receptacle for use as a water proof container arranged for sunbathing, comprising:

a substantially rectangular air mattress made of pliable vinyl and comprising a plurality of longitudinally aligned inflatable tubes with said tubes having intercommunicating air passages at the tube ends, said tubes being fabricated of clear plastic material on an upper side and reflective plastic material on a lower side, said air mattress being formed by continuous welds along both sides of said tubes and along a set of extending edges of said mattress, said receptacle further comprising a pair of stacked tube members exterior of said mattress, said stacked tube members arranged to inflate and deflate simultaneously with inflation and deflation of said mattress, said extending edges of said mattress being affixed between said stacked tubes to form said water proof container when inflated, said clear upper side of said mattress tubes providing a supporting surface for a user of said air mattress, said air mattress being suspended centrally between said stacked tube members with the lower of said stacked tube wall members being a supporting base for said mattress and the upper of said stacked tube members forming a containment wall surrounding said mattress, said containment wall being gradually enlarged towards and around one end of said mattress forming an enlarged end therefor.

2. An inflatable plastic pillow, comprising a substantially rectangular configuration with a wedge shape, said pillow arranged to support a user and in position against a short back rest, said plastic pillow fabricated from clear plastic material on an upper side and said sides being joined at their edges and from reflective plastic material on a lower side transversely affixed internally by two substantially rectangular reflective plastic partitions, said partitions being fastened along one longer longitudinal side to said clear plastic material and along an opposing longitudinal side to said reflective plastic material with said reflective plastic partitions maintaining said wedge shape, said reflective plastic pillow partitions being unfastened at the shorter ends to the side edges thereof producing rounding on all four sides of said plastic pillow when inflated and providing air passageway openings between the partitioned sections allowing inflation and deflation of said plastic pillow from an installed single controllable air valve.

* * * * *